US008094842B2

(12) United States Patent
Noro et al.

(10) Patent No.: US 8,094,842 B2
(45) Date of Patent: Jan. 10, 2012

(54) LOUDSPEAKER SYSTEM AND LOUDSPEAKER ENCLOSURE

(75) Inventors: Masao Noro, Hamamatsu (JP); Akira Arai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1244 days.

(21) Appl. No.: 11/812,056

(22) Filed: Jun. 14, 2007

(65) Prior Publication Data

US 2007/0291965 A1 Dec. 20, 2007

(30) Foreign Application Priority Data

Jun. 16, 2006 (JP) ..... 2006-167274

(51) Int. Cl.
*H04R 7/00* (2006.01)

(52) U.S. Cl. ..... 381/186; 381/345; 381/346; 381/348; 381/398; 381/353; 381/354; 181/155; 181/156; 181/199

(58) Field of Classification Search ..... 381/182, 381/345, 346, 348, 398, 353, 354, 186; 181/155, 181/156, 199
See application file for complete search history.

(56) References Cited

U.S. PATENT DOCUMENTS 6,396,936 B1 * 5/2002 Nevill ..... 381/349
2007/0127760 A1 6/2007 Saiki et al.

FOREIGN PATENT DOCUMENTS

WO WO 00/32010 A2 6/2000
WO WO 2005/101896 A1 10/2005

OTHER PUBLICATIONS

Chinese Office Action dated Sep. 1, 2010 with English translation (eight (8) pages).

* cited by examiner

*Primary Examiner* — Ngan Ngo
*Assistant Examiner* — Benjamin Tzu-Hung Liu
(74) *Attorney, Agent, or Firm* — Crowell & Moring LLP

(57) ABSTRACT

A loudspeaker system includes a loudspeaker enclosure having an inside space, a loudspeaker provided on the loudspeaker enclosure, a first diaphragm which has one of ends fixed to a surface of the loudspeaker enclosure and the other end, a second diaphragm which has one of ends fixed to the surface of the loudspeaker enclosure and the other end, a coupling portion having an elasticity, and coupling the other end of the first diaphragm to the other end of the second diaphragm, an opening structure provided in the surface of the loudspeaker enclosure, and a sealing member provided to a portion among the first and second diaphragms, the coupling portion and an edge part of the opening structure, and closing the inside space to hold an airtightness of the loudspeaker enclosure in a state that the first and second diaphragms can be vibrated.

2 Claims, 15 Drawing Sheets

B-B'

C-C'

D-D'

E-E'

F-F'

G-G'

M-M'

N-N'

LOUDSPEAKER SYSTEM AND LOUDSPEAKER ENCLOSURE

BACKGROUND OF THE INVENTION

The present invention relates to a technique of a loudspeaker system and a loudspeaker enclosure.

As a loudspeaker system for reinforcing a low sound, a loudspeaker system of a bass reflex type has been known. In the loudspeaker system of the bass reflex type, a resonant tube for coupling an internal space and an external space of an enclosure is provided in the enclosure having a loudspeaker unit, and a Helmholtz resonance is utilized to reinforce the low sound. In the case in which a volume of the enclosure is small in the loudspeaker system, however, the resonant tube is to be small-sized and elongated in order to reduce a resonance frequency. Consequently, an air resistance is increased so that a low sound reinforcing function is remarkably deteriorated. Moreover, there is a problem in that a wind noise like a whistle is generated because a speed of air passing through the resonant tube is increased very greatly.

It is also possible to provide a drone cone in place of the resonant tube. In the case in which the drone cone is used, however, it is necessary to increase a mass of the drone cone in order to reduce a resonance frequency. In order to reduce the resonance frequency, it is necessary to increase a compliance of an edge for supporting a diaphragm. In order to support the diaphragm having a great mass, however, a spring property and a strength of the edge are to be increased, which is contrary to the compliance. Moreover, it is hard to vibrate a heavy diaphragm completely in parallel, and an abnormal vibration referred to as rolling or rocking is apt to be generated together. The abnormal vibration increases a distortion and consumes a useless energy, thereby reducing an efficiency.

In order to compensate for the defects of the drone cone, for example, there has been proposed a technique disclosed in WO0032010. According to the method, it is possible to prevent the rolling and the rocking. However, there is employed a structure in which the weight of the diaphragm is supported on the edge provided therearound. For this reason, there is a problem in that a strength is required for the edge and Q of a vibration is reduced by a braking effect.

Therefore, the applicant invented a loudspeaker system shown in FIGS. 16 and 17. In the loudspeaker system, a diaphragm 21 which can be vibrated by an elasticity is provided in a state in which one end is fixed to one surface of a loudspeaker enclosure 20. In one surface provided with the diaphragm 21, furthermore, an opening portion is provided in a position corresponding to a vibrating portion of the diaphragm 21, and there is provided a sealing member 23 for closing a gap 22 formed between the diaphragm 21 and an edge part of the opening portion in a state in which the vibration of the diaphragm 21 is enabled and for holding an airtightness of the loudspeaker enclosure 20. The diaphragm 21 thus constituted will be referred to as a passive diaphragm.

In the loudspeaker system, when a speaker unit 10 is driven, a vibration of a cone paper of the speaker unit 10 is propagated to air in the loudspeaker enclosure 20 and the diaphragm 21 is vibrated by the vibration of the air. At this time, the diaphragm 21 to be vibrated in a state in which the sealing member 23 is caused to hold the airtightness reduces or increases an air volume in the loudspeaker enclosure 20 when it is vibrated. Accordingly, a new resonance frequency is generated between a compliance (a mechanical flexibility) to which an air spring of the loudspeaker enclosure 20 is also applied in addition to the elasticity of the diaphragm 21 and an equivalent mass of the diaphragm 21. As a result, there is generated a sound to be reproduced around the resonance frequency of the diaphragm 21. The resonance frequency can easily be set to have a desirable value in a low sound region.

However, the loudspeaker system has the following drawbacks. The diaphragm 21 is wholly bent like a fan and carries out a vibration in a primary mode as shown in FIG. 18A. At the same time, there are generated vibrations in higher order modes, for example, a secondary mode shown in FIG. 18B and a tertiary mode shown in FIG. 18C. When the vibrations in the secondary mode and the tertiary mode are generated, an acoustic wave generated from each portion of the diaphragm 21 is cancelled so that an acoustic converting efficiency is reduced because phases of the vibrations are different from each other in the respective portions of the diaphragm 21.

In general, it is possible to generate the vibration in the primary mode most greatly by properly setting a rigidity of the diaphragm 21. In the case in which the loudspeaker enclosure 20 is designed to be elongated, however, the diaphragm 21 is also elongated. In the case in which the diaphragm 21 having a flexibility which can carry out the vibration by the bending is set to be exactly elongated, an apparent bending rigidity in a longitudinal direction is reduced and a component of a higher order vibration is thus increased so that an excellent low sound cannot be reproduced.

SUMMARY OF THE INVENTION

The invention has been made under the background and has an object to provide a loudspeaker system capable of reproducing an excellent low sound in the case in which a passive diaphragm having an elongated shape is used.

In order to solve the problems, the invention provides a loudspeaker system, comprising:

a loudspeaker enclosure which has an inside space;

a loudspeaker which is provided on the loudspeaker enclosure;

a first diaphragm which has one of ends fixed to a surface of the loudspeaker enclosure and the other end which can be freely vibrated;

a second diaphragm which has one of ends fixed to the surface of the loudspeaker enclosure and the other end which can be freely vibrated, the other end of the second diaphragm being provided opposite to the other end of the first diaphragm;

a coupling portion which has an elasticity, and couples the other end of the first diaphragm to the other end of the second diaphragm;

an opening structure which is provided in a position corresponding to vibrating portions of the first and second diaphragms and the coupling portion in the surface of the loudspeaker enclosure, and by which the inside space of the loudspeaker enclosure is exposed; and a sealing member which is provided to a portion among the first and second diaphragms, the coupling portion and an edge part of the opening structure, and closes the inside space exposed by the opening structure to hold an airtightness of the loudspeaker enclosure in a state that the first and second diaphragms can be vibrated.

With the structure, when the loudspeaker is driven, air in the loudspeaker enclosure contracts or expands so that the first and second diaphragms are vibrated. The other end of the first diaphragm and that of the second diaphragm are coupled to each other through the coupling portion. Therefore, one of the ends of the first diaphragm and that of the second diaphragm are set to be fixed ends and the first diaphragm and the second diaphragm are integrated and vibrated in a primary vibrating mode.

This can be regarded to be equivalent to the following. More specifically, as shown in FIG. 19A, both ends of one elongated diaphragm are completely fixed to the loudspeaker enclosure, and edge parts excluding the both ends thus fixed and the loudspeaker enclosure are coupled to each other through a flexible edge, and the diaphragm carries out the vibration in the primary mode as a dual-support diaphragm. In case of a loudspeaker of a large-sized tallboy type (an enclosure is vertical and a ratio of a height to a width is high), similarly, it is possible to reproduce a sufficient low sound with the simple structure by regulating a balance of the rigidity and the mass of the diaphragm.

In case of the simple structure, however, a vibration enable amplitude of the dual-support diaphragm depends on an elongation in a longitudinal direction of the diaphragm. When a stretchable and flexible diaphragm is used to obtain a sufficient vibration, the bending rigidity of the diaphragm is reduced. Consequently, the higher order vibrations in the secondary mode shown in FIG. 19B and the tertiary mode shown in FIG. 19C are generated. As a result, a low sound cannot be reproduced sufficiently.

In the invention, therefore, one dual-support diaphragm is replaced with two cantilever diaphragms, and the regulation of the resonance frequency and the suppression of the higher order vibration are carried out by regulating the mass and the rigidity of each of the diaphragms, and the vibration enable amplitude can be determined depending on the flexibility of the coupling portion of the two diaphragms. More specifically, the two cantilever diaphragms are vibrated in phase in the primary mode, respectively. In the case in which the two diaphragms and the coupling portion are regarded to be one diaphragm, the vibration is carried out in the primary mode of the dual-support diaphragm.

Moreover, the invention provides a loudspeaker system, comprising:

a loudspeaker enclosure which has an inside space;

a loudspeaker which is provided on the loudspeaker enclosure;

a diaphragm which has one of ends fixed to a surface of the loudspeaker enclosure and the other end which can be freely vibrated;

a coupling portion which has an elasticity and couples the other end of the diaphragm to the loudspeaker enclosure;

an opening structure which is provided in a position corresponding to a vibrating portion of the diaphragm and the coupling portion in a surface provided with the diaphragm and the coupling portion, and by which the inside space of the loudspeaker enclosure is exposed; and a sealing member which is provided to a portion among the diaphragm, the coupling portion and an edge part of the opening structure, and closes the inside space exposed by the opening structure to hold an airtightness of the loudspeaker enclosure in a state that the diaphragm can be vibrated.

With the structure, when the loudspeaker is driven, air in the loudspeaker enclosure contracts or expands so that the diaphragm is vibrated. The other end of the diaphragm and the surface of the loudspeaker enclosure are coupled to each other through the coupling portion. Therefore, there is brought an approximating state to the state in which one of the ends and the other end of the diaphragm are set to be fixed ends. Thus, the diaphragm is vibrated in a primary vibrating mode.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments according to the invention will be described below with reference to the drawings.

First Embodiment

Figure 1:
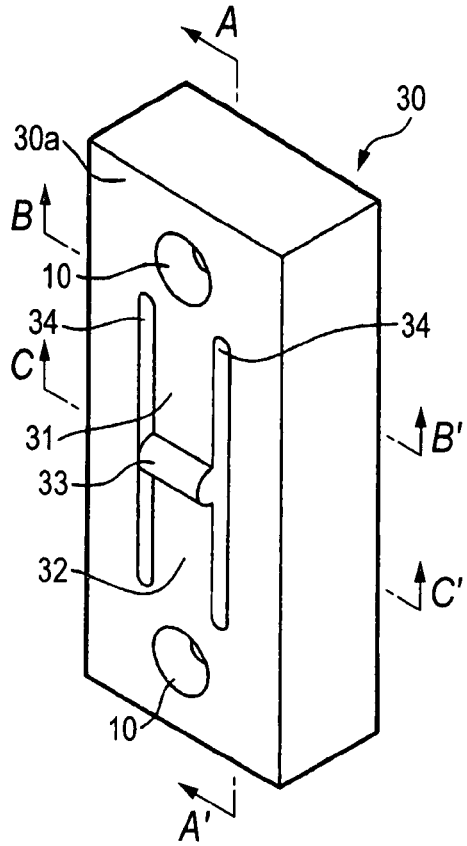
FIG. 1 is a perspective view showing an outer appearance according to a first embodiment.
Figure 2:
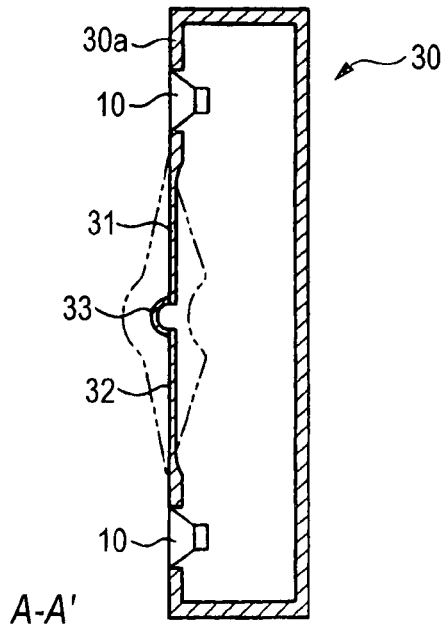
FIG. 2 is a sectional view taken along an A-A' line.

FIG. 1 is a perspective view showing an outer appearance according to a first embodiment of the invention. FIG. 2 is a sectional view taken along an A-A' line in FIG. 1. A loudspeaker enclosure 30 has a shape of a rectangular parallelepiped, and all of six surfaces are formed by plate-shaped members (for example, a wood, a synthetic resin, a metal or a synthetic member obtained by sticking them).

Speaker units 10 (active diaphragm, e.g., dynamic speaker), each having a voice coil and a magnet are respectively attached to upper and lower parts of a baffle plate 30*a* on a front surface.

An opening portion 34 which is cut to be elongated in a vertical direction is provided in a portion between two loudspeakers 10 in the baffle plate 30*a*. A portion interposed between the two opening portions 34 is constituted by passive diaphragms 31 and 32 and a coupling portion 33. An upper end of the passive diaphragm 31 and a lower end of the passive diaphragm 32 are integrated with the baffle plate 30*a*, and the passive diaphragms 31 and 32 are formed more thinly than the other portions. The passive diaphragm 31 can be freely vibrated by an elasticity in a state in which the upper end is fixed. Similarly, the passive diaphragm 32 can be freely vibrated by an elasticity in a state in which the lower end is fixed.

A lower end of the passive diaphragm 31 and an upper end of the passive diaphragm 32 are coupled to each other through the coupling portion 33. The coupling portion 33 can be deformed by an elasticity in such a direction that the lower end of the passive diaphragm 31 is separated from the upper end of the passive diaphragm 32. When the coupling portion 33 is thus deformed, the lower end of the passive diaphragm 31 and the upper end of the passive diaphragm 32 are displaced in such a direction as to separate from each other. When an external force deforming the coupling portion 33 is released, the coupling portion 33 is restored to an original shape and the lower end of the passive diaphragm 31 and the upper end of the passive diaphragm 32 are returned to original positions. By such a structure, there is always maintained a state in which the lower end of the passive diaphragm 31 and the upper end of the passive diaphragm 32 are opposed to each other.

The coupling portion 33 may be formed integrally with the passive diaphragms 31 and 32 or the coupling portion 33 created separately from them may be bonded to the passive diaphragms 31 and 32.

The passive diaphragms 31 and 32 are formed by a member having an acoustically sufficient strength and elasticity. The "acoustically sufficient strength" implies to have an air resistance, a density which is sufficiently higher than that of the air, and a strength and an elasticity which generate an acoustic wave in a vibration. Moreover, the passive diaphragms 31 and 32 have such a property that the acoustic wave can be blocked to some degree by themselves.

Moreover, a degree of "elasticity" is such that a deadweight can be supported and held almost horizontally when each of the passive diaphragms 31 and 32 is put horizontally with one side fixed. In order to satisfy the characteristics, the passive diaphragms 31 and 32 are formed by thin wood plates, thin synthetic resins, metallic plates or synthetic members obtained by sticking them, for example.

Figure 3A:
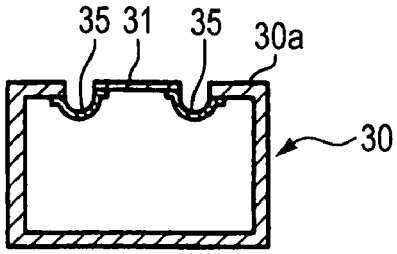
FIG. 3A is a sectional view taken along a B-B' line and FIG. 3B is a sectional view taken along a C-C' line.
Figure 3B:
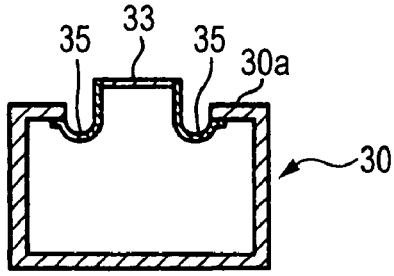

FIGS. 3A and 3B are a sectional view taken along a B-B' line in FIG. 1 and a sectional view taken along a C-C' line in FIG. 1, respectively. As shown in these drawings, the opening portion 34 is covered with an edge 35 taking a U-shaped section from an inside of the loudspeaker enclosure 30. Consequently, an airtightness of the loudspeaker enclosure 30 can be held.

Figure 4:
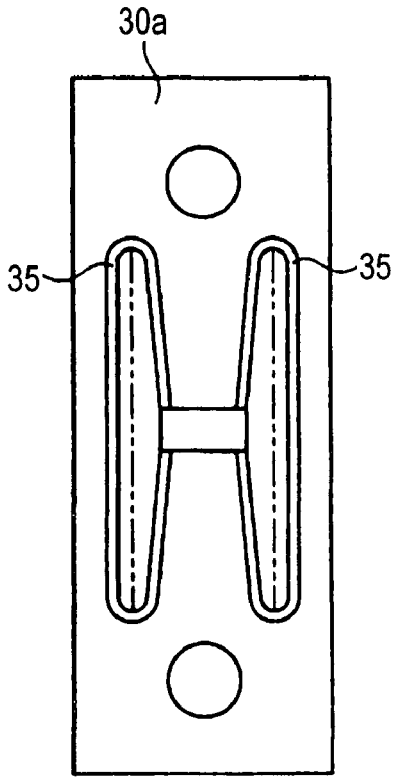
FIG. 4 is a view showing a back face of a baffle plate 30*a;*

FIG. 4 is a view showing a back face of the baffle plate 30*a*. The edge 35 covers the opening portion 34 along a shape thereof.

The edge 35 does not need to support the weights of the passive diaphragms 31 and 32, and preferably has only the function of maintaining the airtightness. Accordingly, a soft material can be used and it is possible to bring an easy moving state in which the vibrations of the passive diaphragms 31 and 32 are not suppressed.

The edge 35 may be provided on the front surface of the baffle plate 30*a*.

With the structure, when the speaker unit 10 is driven, a vibration of a cone paper of the speaker unit 10 is propagated to air in the loudspeaker enclosure 30 and the passive diaphragms 31 and 32 are vibrated by the vibration of the air. At this time, the passive diaphragms 31 and 32 to be vibrated in a state in which the airtightness is held by the edge 35 reduce or increase an air volume in the loudspeaker enclosure 30 when they are vibrated. Accordingly, a new resonance frequency is generated between a compliance (a mechanical flexibility) to which an air spring of the loudspeaker enclosure 30 is applied in addition to the elasticities of the passive diaphragms 31 and 32 and equivalent masses of the passive diaphragms 31 and 32. As a result, there is generated a sound to be reproduced around the resonance frequencies of the passive diaphragms 31 and 32.

The elasticities of the air spring and the passive diaphragms 31 and 32 function in such a manner that two springs are connected equivalently in parallel. However, the air spring has a smaller compliance than that of the spring of each of the passive diaphragms 31 and 32. For this reason, the resonance frequencies of the passive diaphragms 31 and 32 to be the loudspeaker system are almost determined depending on the compliance of the air and the equivalent masses of the passive diaphragms 31 and 32.

The resonance frequency determined as described above can easily be set to have a desirable value in a low sound region. For example, in the case in which a loudspeaker having an effective diameter of 8 cm, the lowest resonance frequency of 70 Hz and Q=0.35 is used for the speaker unit 10, and a net content of the loudspeaker enclosure 30 is set to be 7 litres, the resonance frequency of the diaphragm can be set to be 50 Hz when the masses of the passive diaphragms 31 and 32 are set to be 135 grams.

Figure 5A:
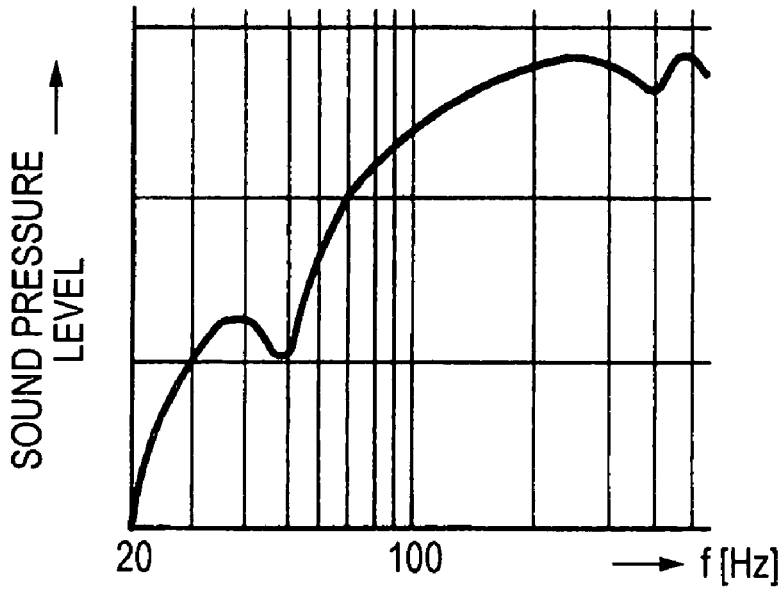
FIGS. 5A and 5B are charts showing frequency characteristics of a speaker unit 10 and passive diaphragms 31 and 32.
Figure 5B:
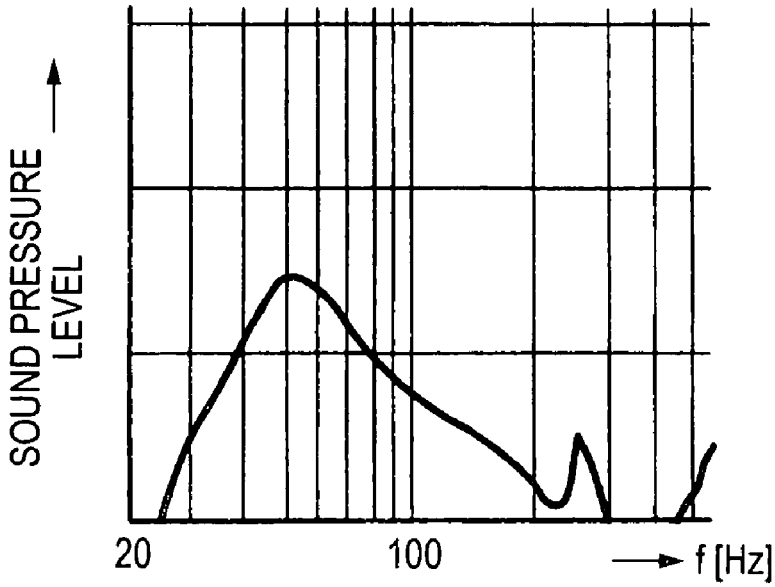

FIG. 5A shows a frequency characteristic of the speaker unit 10 in case of the specific example and FIG. 5B shows a frequency characteristic of the passive diaphragms 31 and 32. As is apparent from the drawings, in the case in which the numeric values are set in the embodiment, it is possible to strongly output a low sound in which the vicinity of 50 Hz is intensified. In the embodiment, thus, the function of a passive radiator such as a drone cone can be obtained by utilizing the bending vibrations of the passive diaphragms 31 and 32.

Moreover, the passive diaphragms 31 and 32 are coupled to each other through the coupling portion 33. Therefore, the portion constituted by the passive diaphragm 31, the coupling portion 33 and the passive diaphragm 32 is vibrated with the upper end of the passive diaphragm 31 and the lower end of the passive diaphragm 32 set to be fixed ends. The vibration is carried out mainly in the primary vibrating mode. The reason is as follows. A higher order vibrating mode such as a secondary, tertiary or more vibrating mode is present in the portion. Since the passive diaphragms 31 and 32 are driven by the air in the loudspeaker enclosure 30, however, the vibration in the primary mode is generated most strongly and a generating level of the vibration in the higher order mode is low. By regulating the materials and thicknesses of the passive diaphragms 31 and 32 and the coupling portion 33, moreover, it is possible to reduce the vibration in the higher order mode to be a desirable level. Consequently, it is possible to output a low sound component having an excellent characteristic.

In the embodiment, the passive diaphragms 31 and 32 have such elasticities that can sufficiently support the deadweights. Therefore, the passive diaphragms 31 and 32 can be held horizontally by themselves even if they are put horizontally. Moreover, the elasticities of the passive diaphragms 31 and 32 themselves have a compliance of a free resonance. However, internal losses of the passive diaphragms 31 and 32 having the elasticities are much smaller than the internal loss of the edge 35 having the same elasticity. Therefore, the loss in the vibration is sufficiently small.

Moreover, the edge 35 according to the embodiment can be formed by a softer material than an edge to be used in a conventional drone cone, and furthermore, a mechanical strength is not required. In the passive radiator of the conventional drone cone, it is necessary to employ a structure in which a rigid diaphragm is supported by the edge. Therefore, the edge has two functions of supporting the diaphragm and maintaining the airtightness. In the embodiment, however, the passive diaphragms 31 and 32 themselves are caused to have the function of supporting the passive diaphragms 31 and 32. Therefore, the supporting function is not required for the edge 35. For this reason, the edge 35 is sufficient if the airtightness in the speaker enclosure 30 can be held. Therefore, it is possible to use a softer material than any other conventional material, it is possible to create a situation in which the vibrations of the passive diaphragms 31 and 32 are not obstructed, and Q of the vibration can be increased.

Furthermore, it is possible to reduce the resonance frequencies of the passive diaphragms 31 and 32 by increasing the masses of the passive diaphragms 31 and 32. More specifically, it is also possible to carry out the regulation depending on the sizes and materials of the passive diaphragms 31 and 32, and it is also possible to easily carry out the regulation by sticking some member to the passive diaphragms 31 and 32.

Second Embodiment

Figure 6:
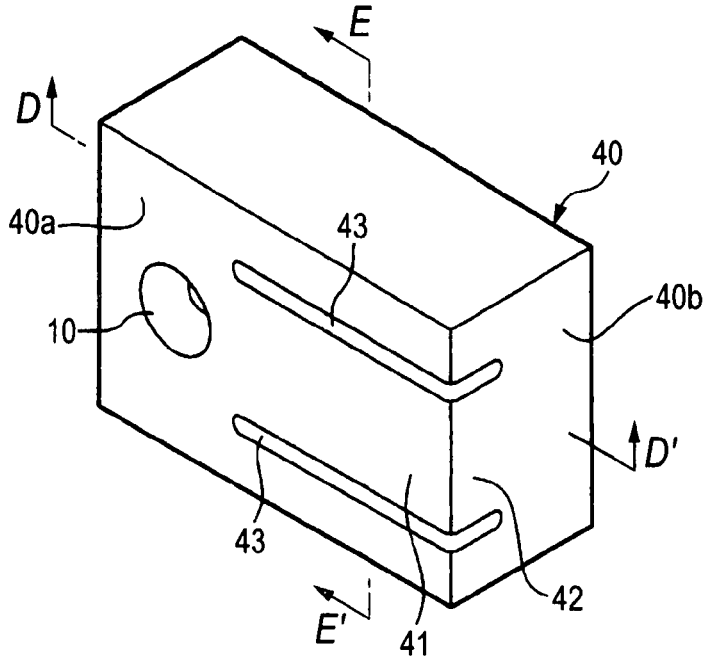
FIG. 6 is a perspective view showing an outer appearance according to a second embodiment.
Figure 7:
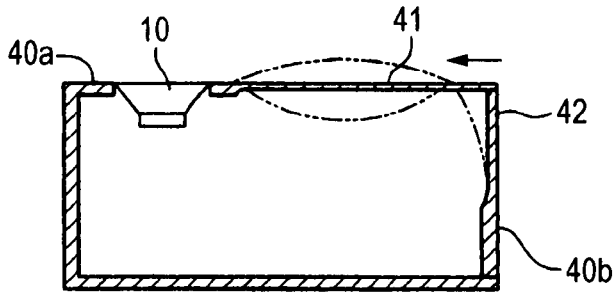
FIG. 7 is a sectional view taken along a D-D' line.

FIG. 6 is a perspective view showing an outer appearance according to a second embodiment of the invention. FIG. 7 is a sectional view taken along a D-D' line in FIG. 6. A loudspeaker enclosure 40 has a shape of a rectangular parallelepiped, and all of six surfaces are formed by plate-shaped members (for example, a wood, a synthetic resin, a metal or a synthetic member obtained by sticking them).

A speaker unit 10 having a voice coil and a magnet is attached to a baffle plate 40*a* on a front surface.

There is provided an opening portion 43 cut to be elongated in a horizontal direction from a central part of the baffle plate 40*a*. The opening portion 43 is provided from the baffle plate 40*a* to a right side plate 40*b* of the loudspeaker enclosure 40. In the baffle plate 40*a*, a portion interposed between two opening portions 43 serves as a passive diaphragm 41. A left end of the passive diaphragm 41 is integrated with the baffle plate 40*a*, and the passive diaphragm 41 is formed more thinly than the other portions. In the right side plate 40*b* of the loudspeaker enclosure 40, a portion interposed between the two opening portions 43 serves as a coupling portion 42. A right end of the coupling portion 42 is integrated with the right side plate 40*b*, and the coupling portion 42 is formed more thinly than the other portions. The passive diaphragm 41 and the coupling portion 42 which are thus formed can be vibrated by an elasticity.

Figure 8:
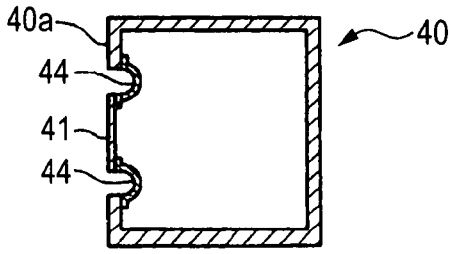
FIG. 8 is a sectional view taken along an E-E' line.

FIG. 8 is a sectional view taken along an E-E' line in FIG. 6. As shown in FIG. 8, the opening portion 43 is covered with an edge 44 from an inside of the loudspeaker enclosure 40. The edge 44 has a U-shaped in cross section. Consequently, an airtightness of the loudspeaker enclosure 40 can be held. The edge 44 does not need to support the weight of the passive diaphragm 41, and preferably has only the function of maintaining the airtightness. Accordingly, a soft material can be used and it is possible to bring an easy moving state in which the vibration of the passive diaphragm 41 is not suppressed.

With the structure, when the speaker unit 10 is driven, a vibration of a cone paper of the speaker unit 10 is propagated to air in the loudspeaker enclosure 40 and the passive diaphragm 41 is vibrated by the vibration of the air. At this time, the passive diaphragm 41 to be vibrated in a state in which an airtightness is held by the edge 44 reduces or increases an air volume in the loudspeaker enclosure 40 when it is vibrated. Consequently, there is generated a sound to be reproduced around the resonance frequency of the passive diaphragm 41 in the same manner as in the first embodiment. By setting the resonance frequency to have a desirable value in a low sound region, it is possible to reinforce a low sound component.

By providing the coupling portion 42, moreover, a movement in a vertical direction on a right end of the passive diaphragm 41 is regulated in FIG. 7. On the other hand, the coupling portion 42 is bent and deformed by an elasticity so that the right end of the passive diaphragm 41 is easily moved in such a direction as to approach the left end (a direction of an arrow in FIG. 7). Therefore, the passive diaphragm 41 is easily deformed to have a curved shape shown in a broken line of FIG. 7. This state approximates to a state in which both ends of the passive diaphragm 41 are set to be fixed ends.

The passive diaphragm 41 in the state described above is driven by the air in the loudspeaker enclosure 40 in the same manner as in the first embodiment. Therefore, a vibration in a primary mode is generated most strongly and a generating level of a vibration in a higher order mode is low. By regulating the materials and thicknesses of the passive diaphragm 41 and the coupling portion 42, moreover, it is possible to reduce the vibration in the higher order mode to have a desirable level.

Accordingly, it is possible to output a low sound component having an excellent characteristic.

<Variant>

The invention is not restricted to the configurations described above but can be carried out in various configurations. For example, the invention can also be carried out in a configuration obtained by changing the embodiments in the following manner.

<Variant 1>

Figure 9:
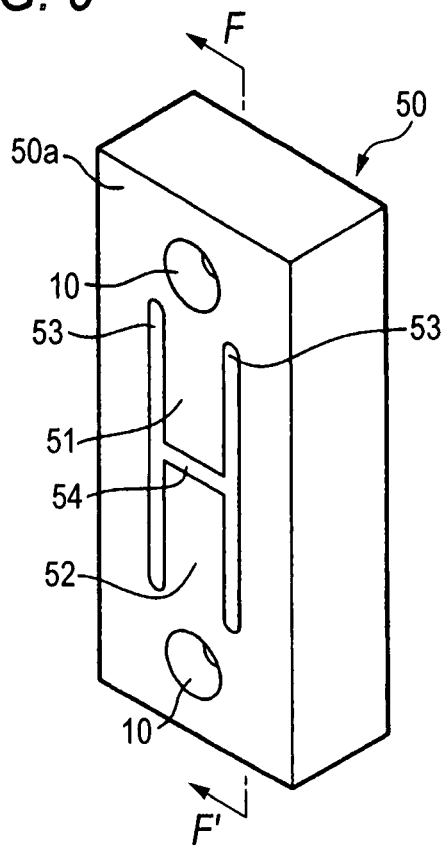
FIG. 9 is a perspective view showing a variant of the first embodiment.
Figure 10:
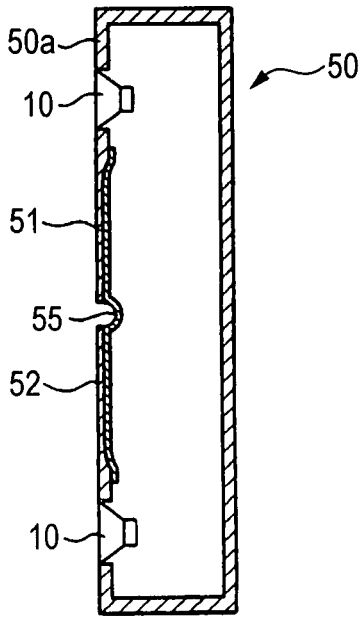
FIG. 10 is a sectional view taken along an F-F' line.

FIG. 9 is a perspective view showing a variant of the first embodiment. FIG. 10 is a sectional view taken along an F-F' line in FIG. 9. In the embodiment, a member corresponding to the coupling portion 33 according to the first embodiment is not provided but an opening portion 54 is provided between a lower end of a passive diaphragm 51 and an upper end of a passive diaphragm 52.

Figure 11:
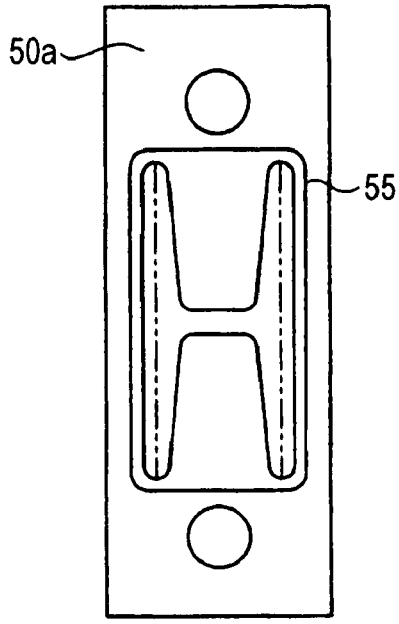
FIG. 11 is a view showing a back face of a baffle plate 50*a;*

FIG. 11 is a view illustrating a back face of a baffle plate 50*a*. An edge 55 for covering the opening portions 53 and 54 along shapes thereof is provided on the back face of the baffle plate 50*a*.

According to the structure, the passive diaphragms 51 and 52 are coupled to each other through the edge 55. Therefore, a portion constituted by the passive diaphragms 51 and 52 and the edge 55 is wholly vibrated by setting an upper end of the passive diaphragm 51 and a lower end of the passive diaphragm 52 to be fixed ends. The vibration is carried out mainly in a primary mode. By regulating the materials and thicknesses of the passive diaphragms 51 and 52 and the edge 55, moreover, it is possible to reduce a vibration in a higher order mode to have a desirable level.

<Variant 2>

Figure 12:
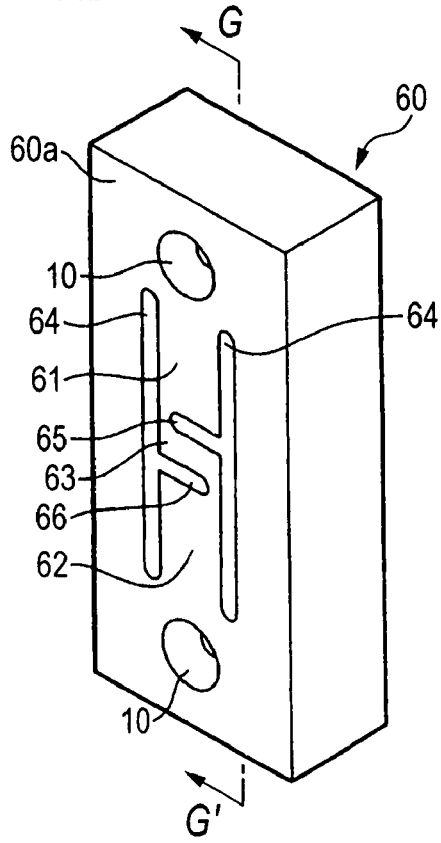
FIG. 12 is a perspective view showing another variant of the first embodiment.
Figure 13:
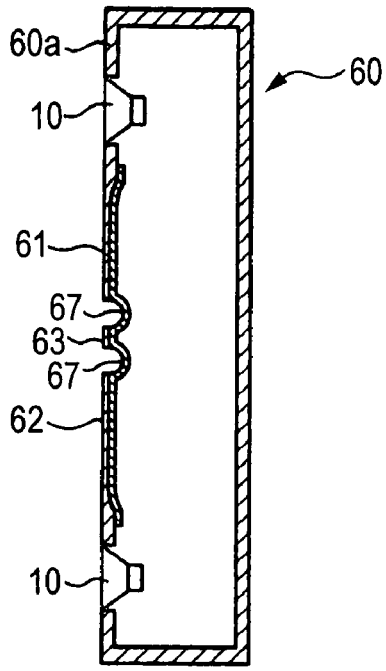
FIG. 13 is a sectional view taken along a G-G' line.

FIG. 12 is a perspective view showing another variant of the first embodiment. FIG. 13 is a sectional view taken along a G-G' line in FIG. 12. In the embodiment, an intermediate plate 63 is provided in place of the coupling portion 33 according to the first embodiment, a part of a lower end of a passive diaphragm 61 and a part of an upper end of the intermediate plate 63 are formed integrally, and a part of an upper end of a passive diaphragm 62 and a part of a lower end of the intermediate plate 63 are formed integrally. Opening portions 65 and 66 are provided between the passive diaphragm 61 and the intermediate plate 63 and between the passive diaphragm 62 and the intermediate plate 63, respectively.

Figure 14:
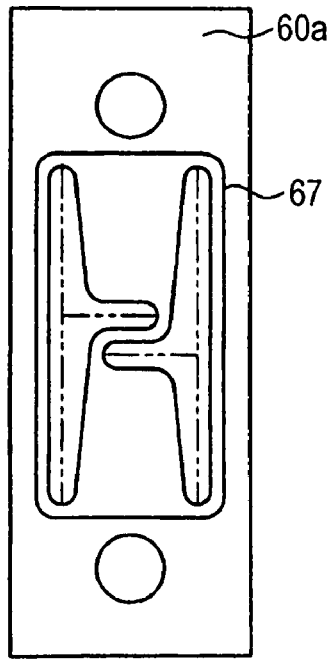
FIG. 14 is a view showing a back face of a baffle plate 60*a;*

FIG. 14 is a view showing a back face of a baffle plate 60*a*. An edge 67 for covering the opening portions 64, 65 and 66 along shapes thereof is provided on the back face of the baffle plate 60*a*.

According to the structure, the passive diaphragms 61 and 62 are coupled to each other through the intermediate plate 63 and the edge 67. Therefore, a portion constituted by the passive diaphragms 61 and 62, the intermediate plate 63 and the edge 67 is wholly vibrated by setting an upper end of the passive diaphragm 61 and a lower end of the passive diaphragm 62 to be fixed ends. The vibration is carried out mainly in a primary vibrating mode. By regulating the materials and thicknesses of the passive diaphragms 61 and 62, the intermediate plate 63 and the edge 67, moreover, it is possible to reduce a vibration in a higher order mode to have a desirable level.

<Variant 3>

Figure 15:
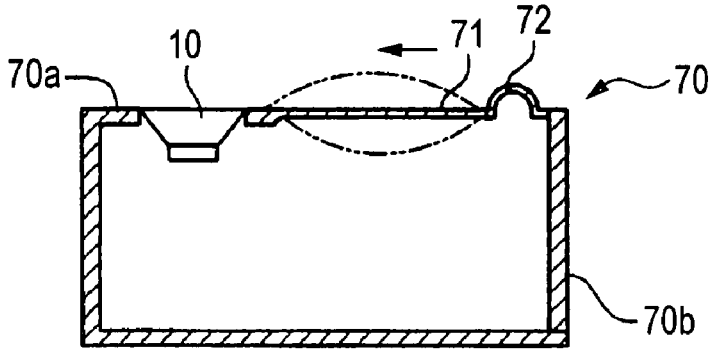
FIG. 15 is a sectional view showing a variant of the second embodiment.
Figure 16:
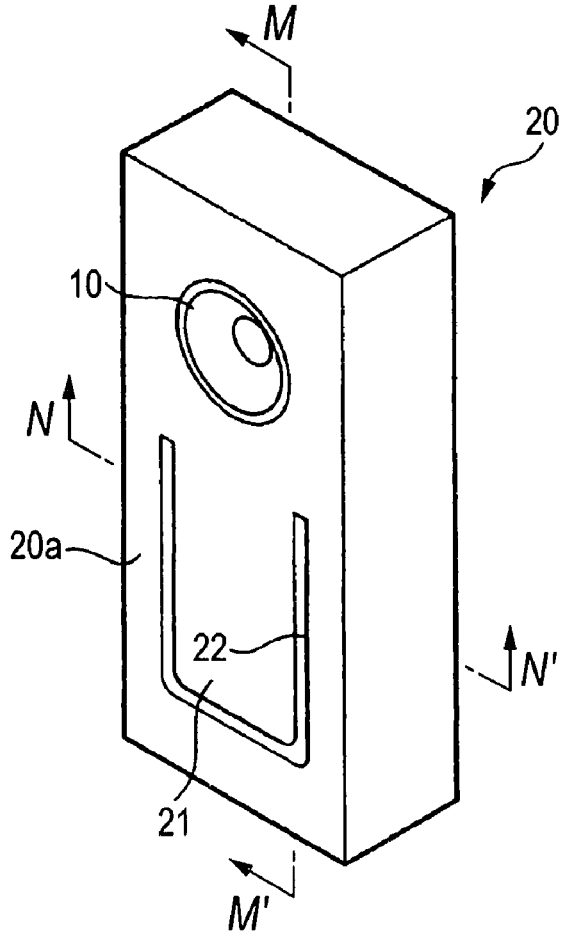
FIG. 16 is a view showing an example of a loudspeaker system.
Figure 17A:
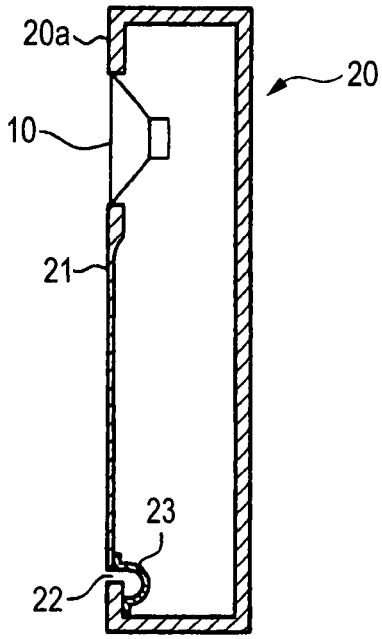
FIG. 17 is a view showing the example of the loudspeaker system.
Figure 17B:
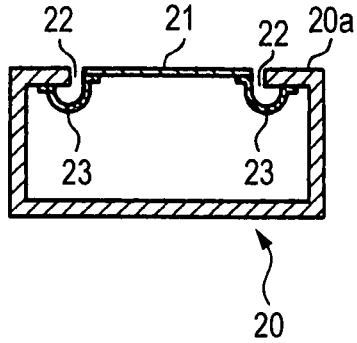
Figure 18A:
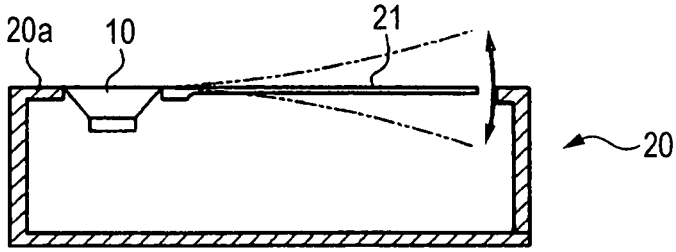
FIGS. 18A, 18B and 18C are views showing states of vibration of a diaphragm.
Figure 18B:
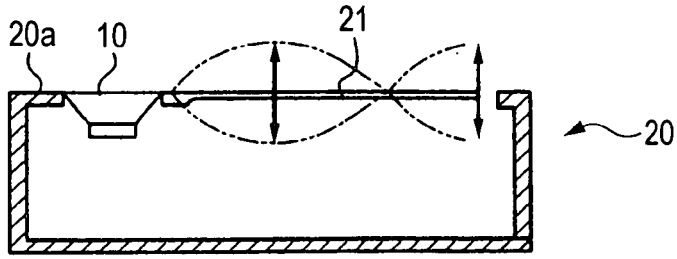
Figure 18C:
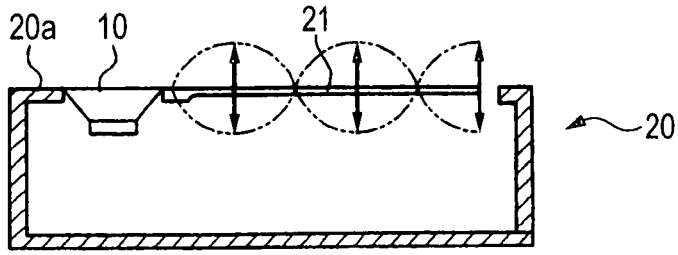
Figure 19A:
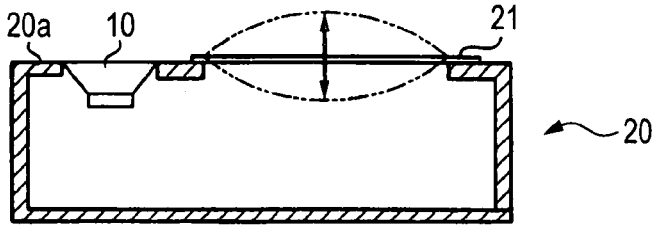
FIGS. 19A, 19B and 19C are views showing the states of the vibration of the diaphragm.
Figure 19B:
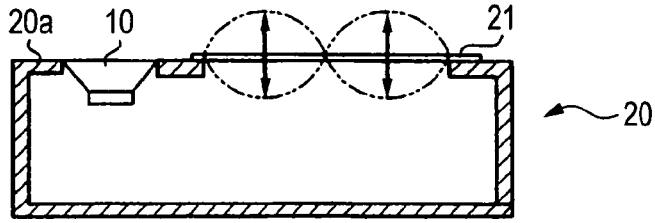
Figure 19C:
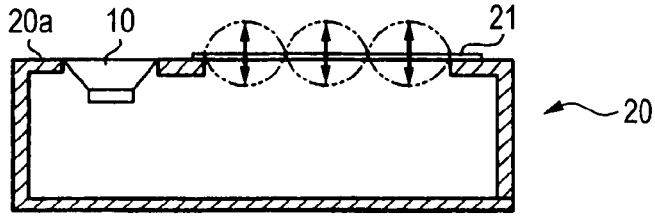

FIG. 15 is a sectional view showing a variant of the second embodiment in the same position as in FIG. 7. In the variant, a member corresponding to the coupling portion 42 according to the second embodiment is not provided but a right end of a passive diaphragm 71 and a right side plate 70*b* of a loudspeaker enclosure 70*a* are coupled to each other through a coupling portion 72. The coupling portion 72 can be deformed by an elasticity. The coupling portion 72 may be formed integrally with the passive diaphragm 71 or the coupling portion 72 created separately from the passive diaphragm 71 may be bonded to the passive diaphragm 71.

By providing the coupling portion 72, a movement in a vertical direction on the right end of the passive diaphragm 71 is regulated in FIG. 15. On the other hand, the coupling portion 72 is bent and deformed by an elasticity so that the right end of the passive diaphragm 71 is easily moved in such a direction as to approach the left end (a direction of an arrow in FIG. 15). Therefore, the passive diaphragm 71 is easily deformed to take a curved shape shown in a broken line of FIG. 15. This state approximates to a state in which both ends of the passive diaphragm 71 are set to be fixed ends.

The passive diaphragm 71 in the state described above is driven by air in a loudspeaker enclosure 70 in the same manner as in the first embodiment. Therefore, a vibration in a primary mode is generated most strongly and a generating level of a vibration in a higher order mode is low. By regulating the materials and thicknesses of the passive diaphragm 71 and the coupling portion 72, moreover, it is possible to reduce the vibration in the higher order mode to have a desirable level.

<Variant 4>

Figure 20:
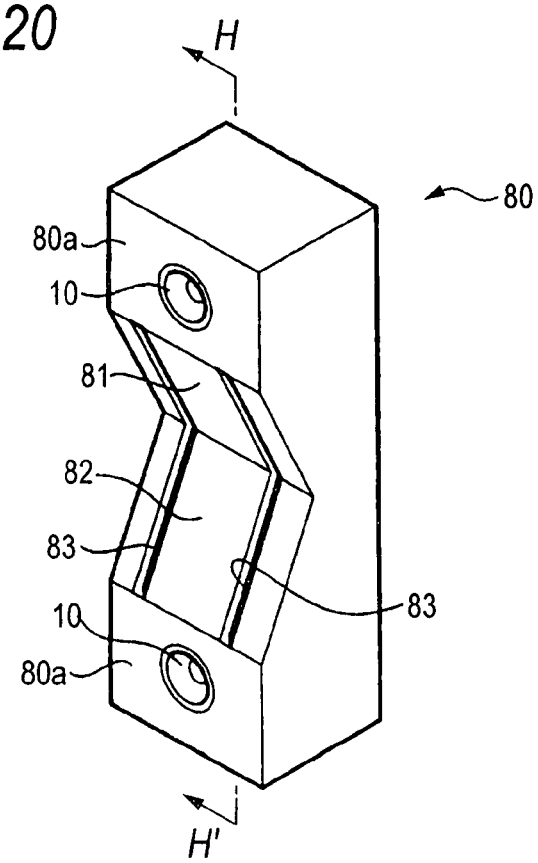
FIG. 20 is a perspective view showing another variant of the second embodiment.
Figure 21:
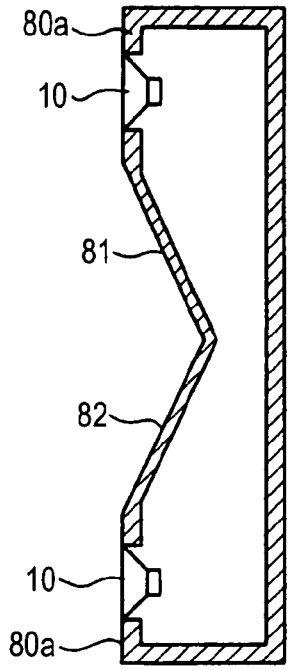
FIG. 21 is a sectional view taken along an H-H' line.

FIG. 20 is a perspective view showing another variant of the second embodiment. FIG. 21 is a sectional view taken along an H-H' line in FIG. 20.

Loudspeakers 10 are attached to upper and lower parts of a baffle plate 80*a*. A portion interposed between the two loudspeakers 10 is bent in such a manner that the vicinity of a center in a longitudinal direction forms a dent toward a back face side. Moreover, an opening portion 83 cut to be elongated in the longitudinal direction is provided in the portion interposed between the two loudspeakers 10. Passive diaphragms 81 and 82 are provided in a portion interposed between the two opening portions 83. An upper end of the passive diaphragm 81 and a lower end of the passive diaphragm 82 are integrated with the baffle plate 80*a*, and the passive diaphragms 81 and 82 are formed more thinly than the other portions. The passive diaphragm 81 can be freely vibrated by an elasticity in a state in which the upper end is fixed. Similarly, the passive diaphragm 82 can be freely vibrated by an elasticity in a state in which a lower part thereof is fixed. A lower end of the passive diaphragm 81 and an upper end of the passive diaphragm 82 are coupled to each other so that the passive diaphragms 81 and 82 are integrated with each other.

Figure 22:
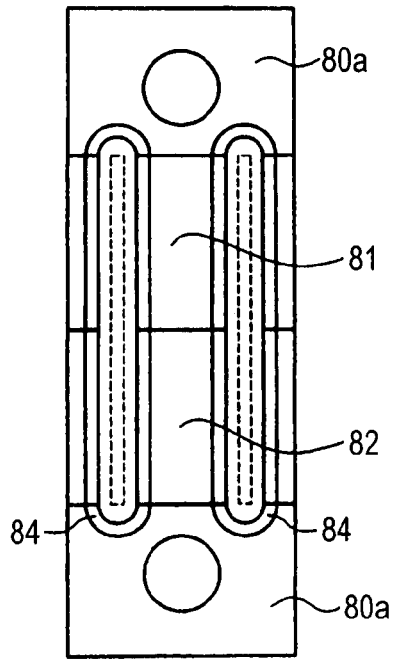
FIG. 22 is a view showing a back face of a baffle plate 80*a;*

FIG. 22 is a view showing a back face of the baffle plate 80*a*. A flexible edge 84 is provided to close the opening portion 83 in a position corresponding to the opening portion 83. Consequently, an airtightness of a loudspeaker enclosure 80 can be maintained.

Figure 23:
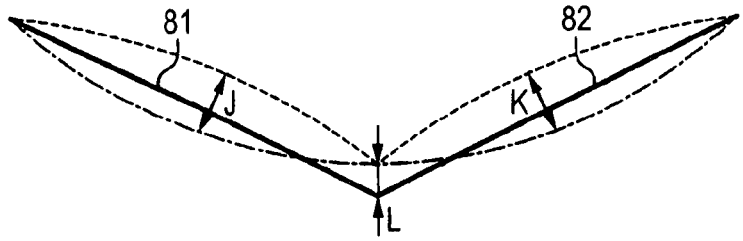
FIG. 23 is a view showing a state of vibrations of diaphragms 81 and 82.
Figure 24:
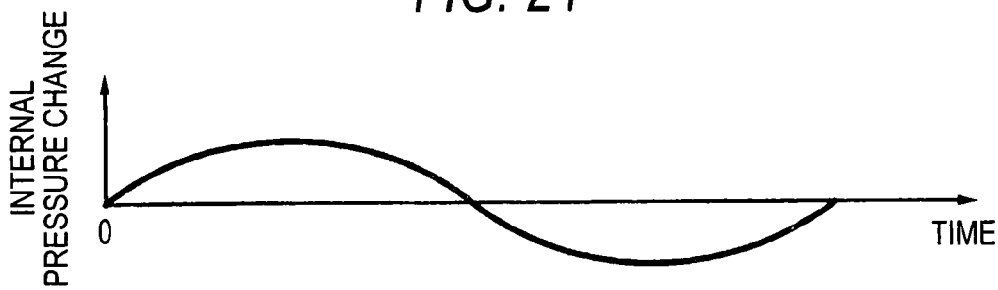
FIG. 24 is a chart representing a change in an internal pressure in a loudspeaker enclosure 80.
Figure 25:
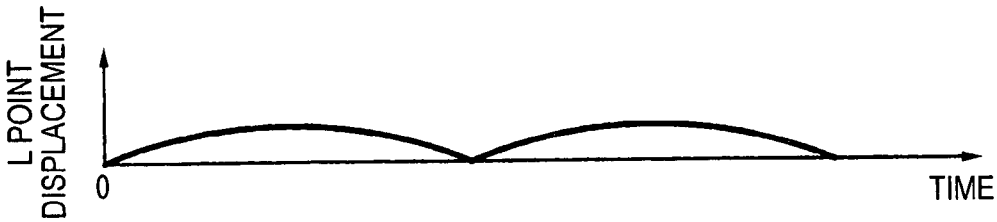
FIG. 25 is a chart representing a displacement of an L point in the case in which the internal pressure is changed.

When the speaker unit 10 is driven, a vibration of a cone paper of the speaker unit 10 is propagated to air in the loudspeaker enclosure 80 and the passive diaphragms 81 and 82 are vibrated by the vibration of the air. FIG. 23 is a view illustrating a state of the vibrations of the passive diaphragms 81 and 82. In the variant, the ends of the two passive diaphragms are coupled to each other, and one of the passive diaphragms functions as the coupling portion 42 in the second embodiment with respect to the other passive diaphragm. FIG. 23 is a view showing a state of a displacement in the case in which a vibration in a primary mode is generated on the passive diaphragms 81 and 82. As shown in FIG. 23, a displacement of an L point to be a coupling point of the passive diaphragms 81 and 82 is smaller than those of a J point to be a center of the passive diaphragm 81 and a K point to be a center of the passive diaphragm 82. FIG. 24 is a chart representing a change in an internal pressure in the loudspeaker enclosure 80. An axis of abscissas indicates a time and an axis of ordinates indicates an internal pressure. FIG. 25 is a chart representing the displacement of the L point in the case in which the internal pressure is changed as shown in FIG. 24. An axis of abscissas indicates a time and an axis of ordinates indicates a displacement amount. The passive diaphragms 81 and 82 are vibrated as passive diaphragms having both ends fixed, and the L point is vibrated as shown in FIG. 25 with the change in the internal pressure. By regulating a rigidity of each of the passive diaphragms, moreover, the passive diaphragm can be vibrated mainly in the primary mode. By regulating a mass of each of the passive diaphragms, furthermore, it is possible to regulate a resonance frequency of the passive diaphragm.

The number of the loudspeakers 10 may be one, or three or more. Moreover, the speaker unit 10 may be provided on separate surfaces from the passive diaphragms 81 and 82.

<Variant 5>

Figure 26:
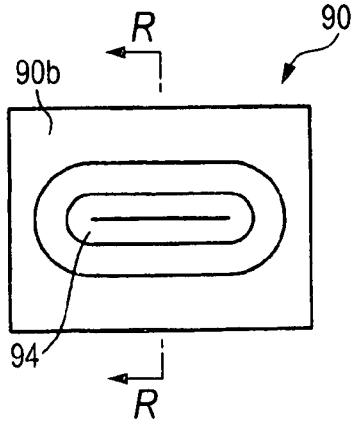
FIG. 26 is a view showing a front surface of a loudspeaker enclosure 90.
Figure 27:
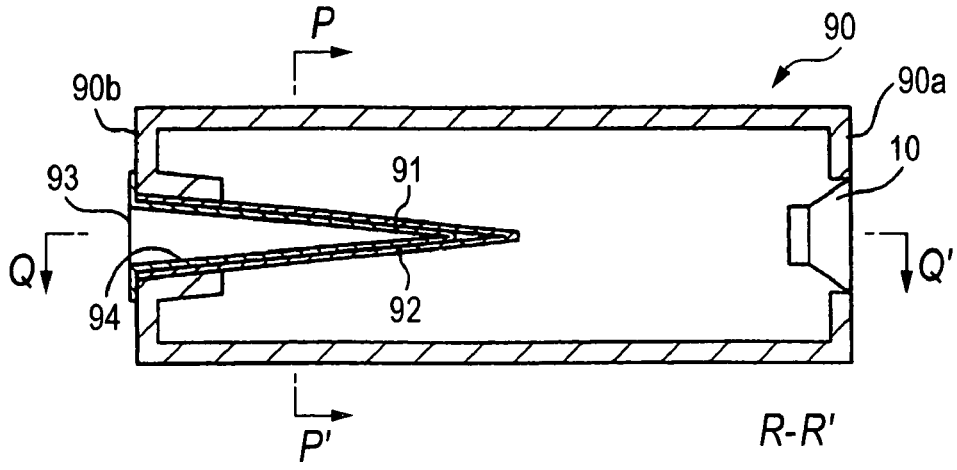
FIG. 27 is a sectional view taken along an R-R' line.
Figure 28:
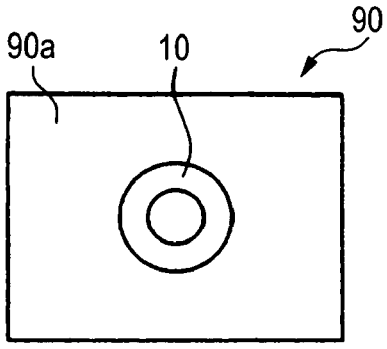
FIG. 28 is a view showing a back face.

FIG. 26 is a view showing a front surface of a loudspeaker enclosure 90 according to a further variant of the second embodiment. FIG. 27 is a sectional view taken along an R-R' line in FIG. 26. FIG. 28 is a view showing a back face of the loudspeaker enclosure, 90. In short, the loudspeaker enclosure 90 has such a feature that an interposing angle between the passive diaphragms 81 and 82 according to the variant 4 is reduced extremely. An elliptical opening portion 93 is provided on a front plate 90*b* of the loudspeaker enclosure 90. Ends of passive diaphragms 91 and 92 are attached to upper and lower edges of the opening portion 93 respectively, and the other ends of the passive diaphragms 91 and 92 are coupled to each other in the loudspeaker enclosure 90.

Figure 29:
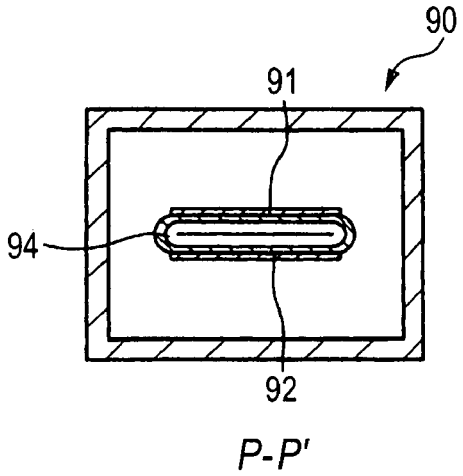
FIG. 29 is a sectional view taken along a P-P' line.
Figure 30:
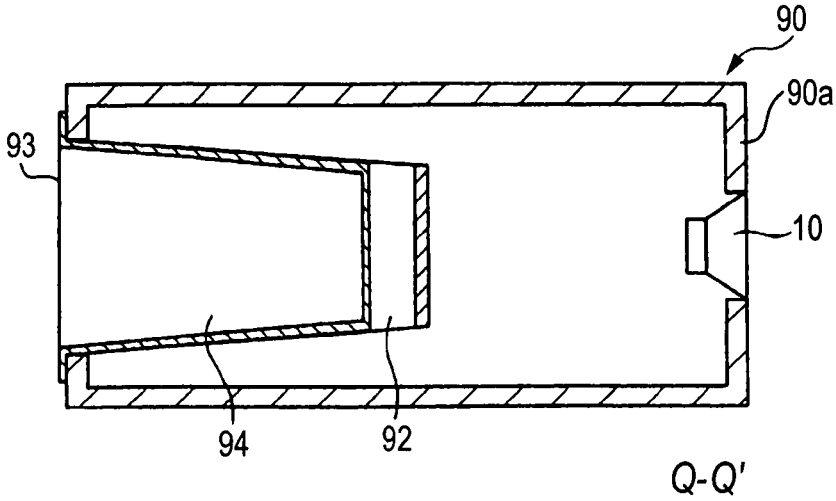
FIG. 30 is a sectional view taken along a Q-Q' line.
Figure 32:
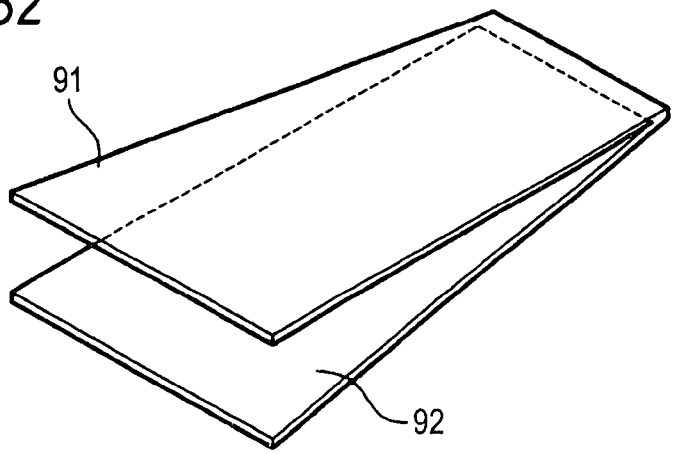
FIG. 32 is a perspective view showing a state in which the diaphragms 91 and 92 are coupled to each other.
Figure 33:
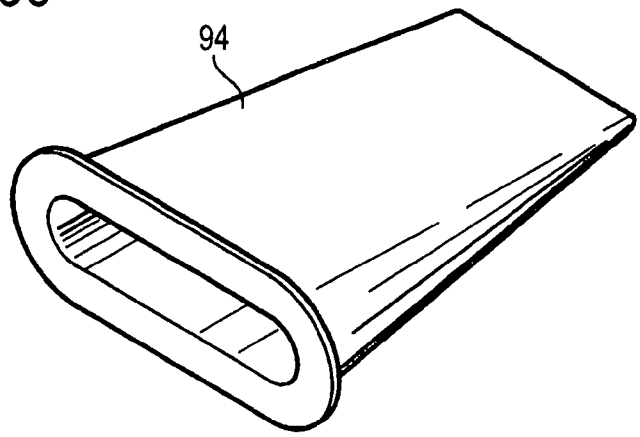
FIG. 33 is a perspective view showing an edge 94.

FIG. 29 is a sectional view taken along a P-P' line in FIG. 27, and FIG. 30 is a sectional view taken along a Q-Q' line in FIG. 27. FIG. 32 is a perspective view showing a state in which the passive diaphragms 91 and 92 are coupled to each other. FIG. 33 is a perspective view showing an edge 94. A void generated between the loudspeaker enclosure 90 and the passive diaphragms 91 and 92 is closed with the edge 94 formed by a flexible material. The edge 94 has a shape of a pocket, and is formed to be hermetically bonded to the passive diaphragms 91 and 92 when the edge 94 is inserted into a space interposed between the passive diaphragms 91 and 92 as shown in FIGS. 27 and 29. The edge 94 is attached to an edge part of the opening portion 93 of the loudspeaker enclosure 90 and the passive diaphragms 91 and 92 by means such as bonding or welding so that an airtightness of the loudspeaker enclosure 90 can be maintained.

Figure 31:
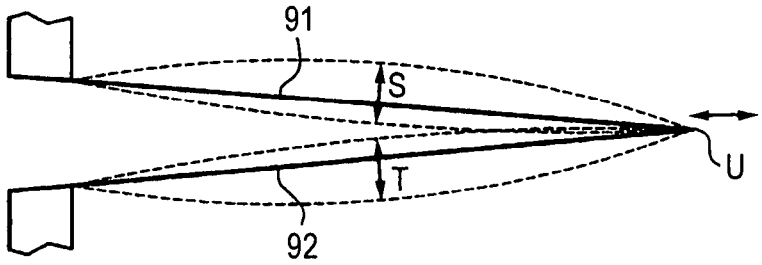
FIG. 31 is a view showing a state of vibrations of diaphragms 91 and 92.

When the speaker unit 10 is driven, a vibration of a cone paper of the speaker unit 10 is propagated to air in the loudspeaker enclosure 90 and the passive diaphragms 91 and 92 are vibrated by the vibration of the air. FIG. 31 is a view illustrating a state of the vibrations of the passive diaphragms 91 and 92. An S point to be a center of the passive diaphragm 91, a T point to be a center of the passive diaphragm 92, and a U point to be a coupling point of the passive diaphragms 91 and 92 are displaced in the same manner as the J, K and L points in FIG. 23, respectively.

Figure 34A:
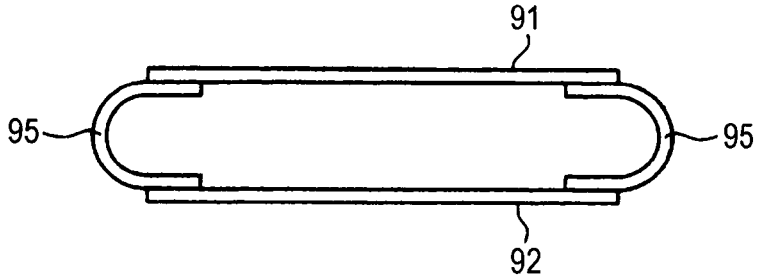
FIGS. 34A, 34B and 34C are views showing sections of the edge 94.
Figure 34B:
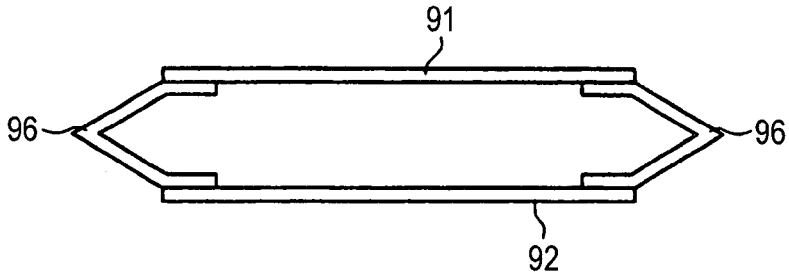
Figure 34C:
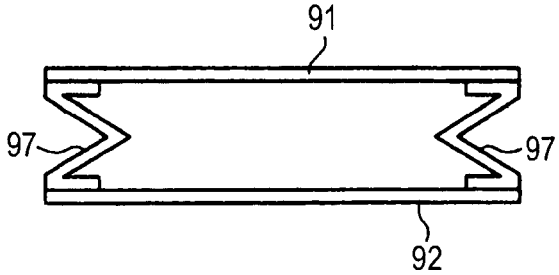

The following edges may be used. FIGS. 34A, 34B and 34C are views showing sections of an edge in the same position as in FIG. 29. FIG. 34A shows an example in which a portion between side ends of the passive diaphragms 91 and 92 is closed with an edge 95 having a U-shaped section, FIG. 34B shows an example in which the portion is closed with an edge 96 which is bent like a V shape, and FIG. 34C shows an example in which the portion is closed with an edge 97 which is bent toward an inside of a space interposed between the passive diaphragms 91 and 92.

[New]

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2006-167274 filed on Jun. 16, 2006, the contents of which are incorporated herein for reference.

What is claimed is:

1. A loudspeaker system, comprising:

a loudspeaker enclosure which has an inside space;

a loudspeaker which is provided on the loudspeaker enclosure;

a first diaphragm which has one of ends fixed to a surface of the loudspeaker enclosure and the other end which can be freely vibrated;

a second diaphragm which has one of ends fixed to the surface of the loudspeaker enclosure and the other end which can be freely vibrated, the other end of the second diaphragm being provided opposite to the other end of the first diaphragm;

a coupling portion which has an elasticity, and couples the other end of the first diaphragm to the other end of the second diaphragm;

an opening structure which is provided in a position corresponding to vibrating portions of the first and second diaphragms and the coupling portion in the surface of the loudspeaker enclosure, and by which the inside space of the loudspeaker enclosure is exposed; and a sealing member which is provided to a portion among the first and second diaphragms, the coupling portion and an edge part of the opening structure, and closes the inside space exposed by the opening structure to hold an airtightness of the loudspeaker enclosure in a state that the first and second diaphragms can be vibrated.

2. A sealing type loudspeaker enclosure, comprising:

an enclosure body which has an attachment hole to which a loudspeaker is to be attached;

a first diaphragm which has one of ends fixed to a surface of the enclosure body and the other end which can be freely vibrated;

a second diaphragm which has one of ends fixed to the surface of the enclosure body and the other end which can be freely vibrated, the other end of the second diaphragm being provided opposite to the other end of the first diaphragm;

a coupling portion which has an elasticity, and couples the other end of the first diaphragm to the other end of the second diaphragm;

an opening structure which is provided in a position corresponding to vibrating portions of the first and second diaphragms and the coupling portion in the surface of the enclosure body, and by which the inside space of the enclosure body is exposed; and a sealing member which is provided to a portion among the first and second diaphragms, the coupling portion and an edge part of the opening structure, and closes the inside space exposed by the opening structure to hold an airtightness of the enclosure body in a state that the first and second diaphragms can be vibrated.

* * * * *